US005575298A

United States Patent [19]

Hinton

[11] Patent Number: 5,575,298

[45] Date of Patent: Nov. 19, 1996

[54] APPARATUS AND METHOD FOR CONCEALING ATTACHMENTS OF HAIR SUPPLEMENTS

[76] Inventor: Cassandra Hinton, 16770 Starboard View Dr., Friendswood, Tex. 77546

[21] Appl. No.: 372,932

[22] Filed: Jan. 17, 1995

[51] Int. Cl.[6] ..... A45D 24/00

[52] U.S. Cl. ..... 132/200; 132/201; 132/53; 132/71.1; 132/72.1

[58] Field of Search ..... 132/201, 53, 54, 132/56, 69.1, 71.1, 72.1, 200

[56] References Cited

U.S. PATENT DOCUMENTS

| | | | |
|---|---|---|---|
| 3,280,826 | 10/1966 | Jenkins | 132/201 |
| 3,710,452 | 1/1973 | Hamrick | 132/53 |
| 4,176,669 | 12/1979 | Levin | 132/201 |
| 4,966,173 | 10/1990 | Russell | 132/53 |
| 5,121,761 | 6/1992 | Meister | 132/201 |

*Primary Examiner*—Gene Mancene
*Assistant Examiner*—Pedro Philogene
*Attorney, Agent, or Firm*—Harrison & Egbert

[57] ABSTRACT

An apparatus for concealing a hair supplement attachment including a layer having a top surface and a bottom surface, an adhesive affixed to the bottom surface, and a plurality of human hair particles affixed to the top surface. The plurality of human hair particles generally cover the top surface. The adhesive is of sufficient strength so as to attach to human hair without pulling the hair from the scalp upon removal. The layer has a length generally corresponding to a length of an end of the hair supplement. The plurality of human hair particles have a color generally matching a color of the hair supplement. The layer is applied over a braid which is formed in the human hair so as to receive the end of the hair supplement.

8 Claims, 1 Drawing Sheet

APPARATUS AND METHOD FOR CONCEALING ATTACHMENTS OF HAIR SUPPLEMENTS

TECHNICAL FIELD

The present invention relates to hair supplements generally. More particularly, the present invention relates to devices and methods for attaching additional hair wefts to existing hair on the scalp of a human being. More particularly, the present invention relates to techniques for concealing the positioning and affixing of such hair supplements to the scalp.

BACKGROUND ART

The hair weave process is a widely used service in which supplemental hair is added to existing hair. This hair weave process is used by all races, especially women of color. Hair thinness often occurs because of heredity, age, or breakage. Style consciousness causes such women with thinning hair to attempt to thicken or lengthen the hair by the hair weave process. In this hair weave process, hair is attached by machine, by bonding, by gluing, by hand sewing, or by clipping onto existing hair. When this supplemental hair is permanently positioned on existing hair, a weaved weft of hair is attached to a tract of hair at the root. This tract of hair can be formed by making a small braid by hand. This supplemental hair can then be bonded or hand sewn to the small braid of hair.

As a result of the attachment of this supplemental hair to the braid or to the tract of hair, the point of attachment or the line of demarcation is visible. Under normal circumstances, this point of attachment or line of demarcation is not clearly visible. Unfortunately, there are various circumstances in which the hair is moved so that this attachment point is visible. For example, hair which is displaced by carelessness or by blowing wind will cause the covering hair to lift from the attachment. As a result, those persons in proximity will be able to note that the supplemental hair has been added to the existing hair. Many times, the possibility of having the weave exposed will cause women to avoid the hair weave process. The exposure of the attachment point can be very embarrassing.

It is an object of the present invention to provide an apparatus and method for the covering of the point of attachment or the line of demarcation for the supplemental hair.

It is another object of the present invention to provide an apparatus and method that allows the hair supplement attachment to be easily concealed.

It is still a further object of the present invention to provide such an apparatus and method which is easy to manufacture, easy to use, and relatively inexpensive.

These and other objects and advantages of the present invention will become apparent from a reading of the attached specification and appended claims.

SUMMARY OF THE INVENTION

The present invention is an apparatus for concealing a hair supplement attachment comprising a layer having a top surface and a bottom surface, an adhesive affixed to the bottom surface, and a plurality of human hair particles affixed to the top surface. The adhesive is of a sufficient strength so as to attach to the human hair without pulling the hair from the scalp upon removal. The plurality of human hair particles generally cover the top surface of the layer. The layer has a length generally corresponding to a length of the attachment of the hair supplement. The layer has a width of less than one inch. The plurality of hair particles and the top surface of the layer have a color which generally matches a color of the hair supplement.

The present invention is also a method of adding a hair supplement that comprises the steps of: (1) forming a hair supplement of human hair so as to have an end in which the human hair is grouped together; (2) forming a braid in the hair of the person; (3) affixing the end of the hair supplement to the braid; and (4) attaching an adhesive layer over the braid and the end of the hair supplement. The adhesive layer has an outer surface generally covered with human hair particles.

In this method, the adhesive layer is formed by applying human hair particles to the outer surface of the adhesive layer. The adhesive layer has a length generally equal to a length of the braid. The adhesive layer is cut such that the adhesive layer has such a length.

DETAILED DESCRIPTION OF THE INVENTION

Figure 1:
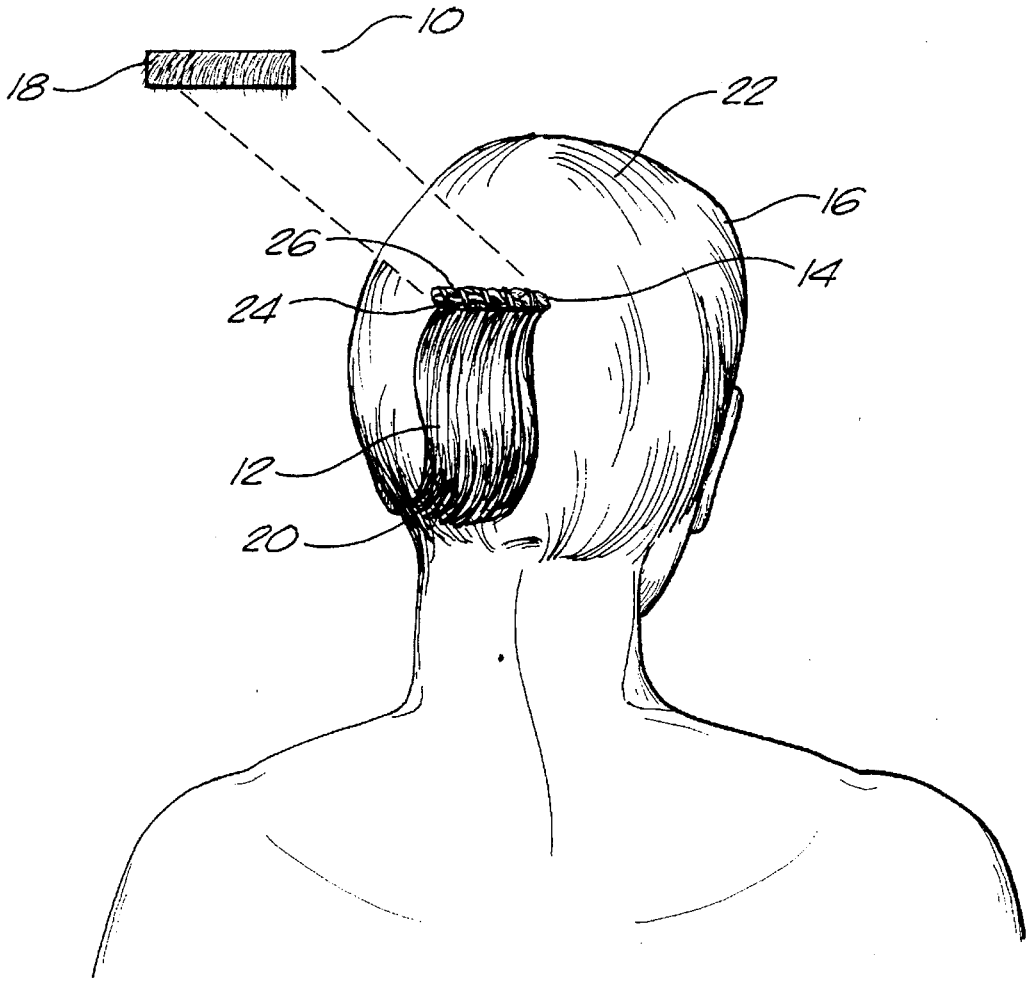
FIG. 1 is an exploded view showing the method and apparatus of the present invention as applied to the hair and head of a human being.

Referring to FIG. 1, there is shown at 10 the apparatus of the present invention for concealing the attachment of a hair supplement. It can be seen that the hair supplement 12 is secured to a braid 14 on a human head 16. The apparatus 10 is shown as securable over the outer surface of the braid 14 and the attachment of the hair supplement 12.

In FIG. 1, it can be seen that the hair supplement 12 includes a weaved weft of hair which is grouped together at one end. The opposite end 20 of the hair supplement 12 extends outwardly freely. In normal use, the hair supplement 12 can be affixed to the scalp of the head 16 so as to be concealed behind the remaining hair 22 of the head 16. As a result, the remaining hair 22 on the head 16 will appear fuller. The supplemental hair 12 will generally blend with the hair 22 so as to present a full head of hair to the viewer. The end 24 of the supplemental hair 12 is attached to the braid 14 of the hair 22. Typically, the end 24 is secured to the braid 14 by bonding or by hand sewing. It can be seen that a thread 26 is illustrated as securing the supplemental hair 12 to the braid 14. If the thread 26 is not used, then glue or other adhesives are used so as to secure the supplemental hair 12.

The braid 14 is formed at a convenient location in the hair 22. The braid is formed from the existing hair on the head 16 in an area proximal the location of thinning hair. When the supplemental hair 12 is secured to the braid 14, the area of thinning hair will be effectively covered.

Under normal circumstances, the application of the supplemental hair 12 to the head 16 will satisfy the needs of the user. Unfortunately, when the user enters a windy condition or condition in which the hair 22 is likely to be displaced, then the user would be extremely concerned about the appearance of the braid 14 and the threads 26. When the remaining hair 22 is displaced, then such an arrangement can be easily exposed. As such, this arrangement could prove embarrassing to the user.

The apparatus 10 of the present invention is applied adhesively over the braid 14 and the threads 26 so as to avoid the accidental discovery (by others) of the weaved hair.

Figure 2:
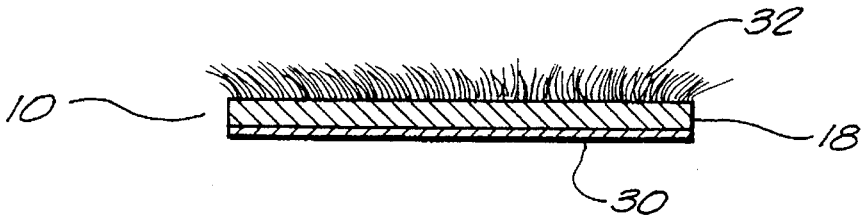
FIG. 2 is a cross-sectional end view of the apparatus of the present invention.

As can be seen in FIG. 2, the apparatus 10 includes a layer 18 that has a sufficient length and width so as to cover the braid 14 and the attachment portion of the hair supplement 12. Normally, the layer 18 will have a length corresponding to that of the braid 14 and has a width of no more than one inch. It can be seen that the layer 18 has a top surface and a bottom surface. An adhesive 30 is affixed to the bottom surface of the layer 18. The adhesive 30 should have sufficient strength so as to attach to the human hair 22 without pulling the hair from the scalp upon removal. As such, the layer 18 is applied and secured directly to the braid 14, to the threads 26, and to the attachment portion 24 of the supplemental hair 12.

A plurality of human hair particles 32 are affixed to the top surface of the layer 18. This plurality of human hair particles 32 generally covers the top surface of the layer 18. The hair particles 32 should have a color which matches the color of the hair supplement 12. The hair particles 32 should also have a color which matches the color of the braid 14. When the apparatus 10 is applied over the braid 14, the threads 26, or any attachment adhesive, are concealed from view. The application of the layer 18 is virtually invisible to the naked eye. As such, the person having the hair supplement 12 can go into windy conditions or into situations in which the hair 22 is likely to be displaced, without fear of having the weave exposed. In effect, the apparatus 10 hides the ugly thread and glue that would show through the braid 14.

The apparatus 10 is a hair weave tape that can be made by using a special strip of colored tape which is covered by a colored glue and sprinkled with chopped weave hair. The outer surface of the layer 18 is fully covered and then dried. The adhesive 30 on the bottom surface of the layer 18 serves to secure this special, flexible, lightweight tape to the dry weft area of the hair extension. In the preferred embodiment, the tape is approximately one-quarter to one-half inch wide. The length of the apparatus 10 is determined by the area to be covered.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A method of adding a hair supplement to a human scalp comprising the steps of:

forming a hair supplement of human hair, said hair supplement having an end in which the human hair is grouped together;

forming a braid in hair of the scalp, said braid having a desired length;

affixing said end of said hair supplement to said braid; and attaching an adhesive layer over said braid and said end of said hair supplement, said adhesive layer having an outer surface generally covered with human hair particles.

2. The apparatus of claim 1, further comprising the step of:

forming the adhesive layer by applying human hair particles to said outer surface such that said human hair particles adhere to said outer surface.

3. The apparatus of claim 1, said step of attaching comprising:

placing said adhesive layer in proximity to said braid, said adhesive layer having a length generally equal to said length of said braid.

4. The method of claim 3, said step of attaching comprising:

cutting said adhesive layer such that said adhesive layer has a length equal to said length of said braid.

5. The method of claim 1, said human hair particles having a color generally matching a color of said hair supplement.

6. The method of claim 5, said human hair particles having a color generally matching a color of said braid.

7. The method of claim 1, said adhesive layer having an adhesive thereon having a sufficient strength so as to adhere to human hair without pulling the hair from the scalp upon removal.

8. The method of claim 1, said step of affixing comprising:

threadedly attaching said human hair supplement to said braid.

* * * * *